US005735620A

United States Patent [19]

Ford

[11] Patent Number: 5,735,620

[45] Date of Patent: Apr. 7, 1998

[54] MULTI-PURPOSE CLEANING TOOL

[76] Inventor: Peggy D. Ford, 1218 Euclid St., NW., Washington, D.C. 20009

[21] Appl. No.: 613,657

[22] Filed: Mar. 11, 1996

[51] Int. Cl.[6] ..... A47L 13/12; A46B 11/00

[52] U.S. Cl. ..... 401/27; 401/39; 401/24

[58] Field of Search ..... 401/186, 140, 401/138, 27, 36, 39, 22, 9, 23, 24, 25, 34

[56] References Cited

U.S. PATENT DOCUMENTS

| | | | |
|---|---|---|---|
| 113,258 | 4/1871 | Charles . | |
| 222,031 | 11/1879 | Gerike . | |
| 612,896 | 10/1898 | Dunn | 401/23 |
| 817,766 | 4/1906 | Hames . | |
| 1,049,797 | 1/1913 | Arntt | 401/140 |
| 1,568,602 | 1/1926 | Harris | 401/140 X |
| 2,112,349 | 3/1938 | Schumacher | 403/87 X |
| 2,581,141 | 1/1952 | Raptis . | |
| 2,823,400 | 2/1958 | Abdo . | |
| 3,115,656 | 12/1963 | McKinstry . | |
| 3,210,794 | 10/1965 | Vosbikian | 401/140 |
| 4,008,504 | 2/1977 | Ou . | |
| 4,150,904 | 4/1979 | Stewart | 401/186 |
| 4,256,409 | 3/1981 | Manley . | |
| 4,618,279 | 10/1986 | Gurevich et al. . | |
| 4,629,347 | 12/1986 | Poppitz | 401/140 X |
| 4,732,503 | 3/1988 | Bader et al. | 401/140 X |
| 4,776,716 | 10/1988 | Huang . | |
| 5,141,348 | 8/1992 | 'tartt | 401/140 X |
| 5,251,351 | 10/1993 | Klotz . | |
| 5,364,198 | 11/1994 | Skenderi | 401/140 X |
| 5,496,123 | 3/1996 | Gaither | 401/140 X |

FOREIGN PATENT DOCUMENTS

| | | | |
|---|---|---|---|
| 1163191 | 12/1956 | France . | |
| 661890 | 3/1964 | Italy | 401/140 |
| 2011781 | 7/1979 | United Kingdom . | |

*Primary Examiner*—Linda C. Dvorak
*Attorney, Agent, or Firm*—Dowell & Dowell

[57] ABSTRACT

A cleaning tool including a housing in which a multi-purpose implement is rotatably mounted so as to selectively position one of a plurality of working surfaces outwardly of the housing. The housing and implement are removably and adjustably mounted to an extendable handle. A liquid container or reservoir is mounted so as to form a portion of the handle so that liquid may be selectively dispensed through the handle to a distribution header in the housing.

20 Claims, 3 Drawing Sheets

11
12
13
14
17
18
30
31
35
36
37
43
52
60
62
65
66
69
72
73
74
80
81
85
86
88

MULTI-PURPOSE CLEANING TOOL

BACKGROUND OF THE INVENTION

1. Field of the Invention

This invention is generally directed to cleaning tools and, more particularly, to a cleaning tool which includes one or more multi-purpose implements which may be selectively mounted within a housing supported at one end of an extendable handle. More particularly, the present invention includes a liquid dispenser which forms a portion of a handle for the tool and by way of which liquid may be supplied through the handle to a distribution header in the housing.

2. History of the Related Art

There have been many cleaning tools designed to offer consumers multiple cleaning options through the selective use of different surfaces associated with the tools. For purposes of this discussion, a cleaning surface is not strictly limited to brushes, sponges, mop-like materials, chamois, buffing materials, polishing surfaces, dusting elements and the like but also includes a variety of scrubbing and sanding elements and combs including sandpapers, emery surfaces, wire scrubbers and finishers and related materials.

There are many instances when it is necessary to utilize a plurality of different cleaning elements to perform a particular task such as cleaning a kitchen or a bathroom and the related fixtures. Often, a sponge, wiping cloth, scrubbing device or other cleaning element may be used. Conventionally, it is necessary to have separate tools for performing each of these cleaning tasks.

In many instances, it is necessary to provide an adequate source of liquid for use with a cleaning tool. For instance, when scrubbing or cleaning walls, it is often necessary to have a cleaning solution or cleaner. When washing a car or other vehicle, it is necessary to provide a cleaning solution as well as a rinsing liquid. When waxing floors or other surfaces, it is necessary to supply a source of wax. With most conventional cleaning instruments, the liquid supply is not related to the actual cleaning implement and therefore additional dispensers and the like must be available.

In U.S. Pat. No. 113,258 to Charles, a cleaning brush is disclosed which includes a cleaning head having a plurality of surfaces on which a cleaning material such as chamois or felt is secured. As one surface becomes worn, the head of the implement may be rotated so that a new surface is oriented for use. In U.S. Pat. No. 817,766 to Hames, a cleaning and polishing device is disclosed having a triangular cross-sectional head on which a plurality of different textured surfaces for cleaning and polishing various objects are mounted so that a single tool may be utilized to perform a variety of tasks.

Variations of adjustable cleaning tools are disclosed in U.S. Pat. No. 4,008,504 to Ou and British patent application 2,011,781. These patents are directed to cleaning tools which include cleaning heads having a plurality of selectively used cleaning surfaces. These tools also include a housing for storing a container of a cleaning solvent, solution, polish or wax so that the liquid is available at any time the tools are placed into use. However, with these structures, the cleaning solution is separately contained and must be separately dispensed for use with the cleaning tool.

To further improve over the utility of other types of cleaning tools, a number of multi-purpose cleaning tools have been designed so as to be mounted to elongated handles, thereby allowing the tools to be utilized to clean hard-to-reach areas. In some of these structures, provision is made for allowing a solution to be supplied to a cleaning head through the handle. Examples of these types of structures are shown in U.S. Pat. Nos. 222,031 to Gerike, 2,823,400 to Abdo, 4,256,409 to Manley and 4,618,279 to Gurevich, et al. and French Patent 1,163,191.

Other examples of adjustable brushes or cleaning instruments are disclosed in U.S. Pat. Nos. 2,581,141 to Raptis, 3,115,656 to McKinstry and 4,776,716 to Huang.

Unfortunately, prior art multi-purpose cleaning tools remain limited in their practical use. It is often very difficult to manipulate a tool so as to properly use a selected cleaning surface on an object or area being cleaned. It is also often difficult to exchange cleaning heads so as to replace worn out implements or to selectively use different cleaning implements. Also, prior art multi-purpose cleaning tools are not sufficiently adjustable to allow their use in both easy-to-reach and hard-to-reach areas. In addition, cleaning tools which incorporate a source of liquid supply are often difficult to utilize with different types of solutions, solvents or waxes as the tools cannot be readily cleaned before use with different liquids.

SUMMARY OF THE INVENTION

The present invention is directed to a multi-purpose cleaning tool which includes a housing in which a cleaning element is selectively rotatably mounted. The cleaning implement includes a plurality of different surface cleaning elements which may be selectively aligned within an opening formed in the housing. The housing is further provided with a liquid distribution header which is molded or formed along the inner wall thereof so as to channel liquid to an edge of the housing adjacent a cleaning element aligned within the opening in the housing.

The housing is adjustably and removably mounted by a pivot attachment to one end of an elongated handle. The handle is extendable including at least one telescoping section mounted within a fixed section with each of the sections being hollow to form a liquid conduit or passageway which communicates through a channel through the pivot attachment with the liquid distribution header in the housing.

The end of the handle remote from the implement housing includes a liquid reservoir or container which, in a preferred embodiment, is a separate squeezable container which may be frictionally or threadingly received in a socket formed in the outer end of the handle. A flap valve is associated with the handle so as to regulate the flow of liquid from the container as pressure is applied to the side walls of the container.

In a preferred embodiment, the liquid container includes a closeable opening in a bottom wall through which additional cleaning solution or other solvents, waxes or liquids may be selectively received so that the container may be refilled as necessary. Alternatively, a hose or other conduit may be directly connected at the opening so as to provide a continuous source of liquid under pressure to the implement or the hose may be directly connected to the outer end of the handle. An end cap is also provided for closing the opening and the cap may include a hanger member so that the tool may be suspended from a hook in a storage area such as a closet.

It is a primary object of the present invention to provide a multi-purpose cleaning tool which includes an adjustable implement head including a plurality of different cleaning elements which may be selectively brought into registry with an opening in a housing which surrounds the implement and wherein the implement may be locked relative to the housing so that the implement is retained in a selectively adjustable position during use.

It is a further object of the present invention to provide a multi-purpose cleaning tool having an adjustable cleaning implement mounted within a housing wherein the housing is removably mounted to an elongated handle so that the housing may be separately used as a hand-cleaning tool or may be mounted to the handle so that the implement may be utilized to work on remote hard-to-reach surfaces.

It is also an object of the present invention to provide a multi-purpose cleaning tool which includes a cleaning implement having a plurality of different cleaning elements wherein liquid may be supplied through an elongated handle from a container carried by the handle and wherein the container may be interchanged with other containers or may be selectively refilled as is necessary. Also, a continuous liquid supply may be provided by securing a conventional hose to the container. Further, in the preferred embodiment, it is also an object of the present invention to provide a handle for use with a tool which includes at least one extendable portion which is telescopically received with respect to another portion of the handle, thereby allowing selected adjustment of the length of the handle.

DESCRIPTION OF THE PREFERRED EMBODIMENT

Figure 1:
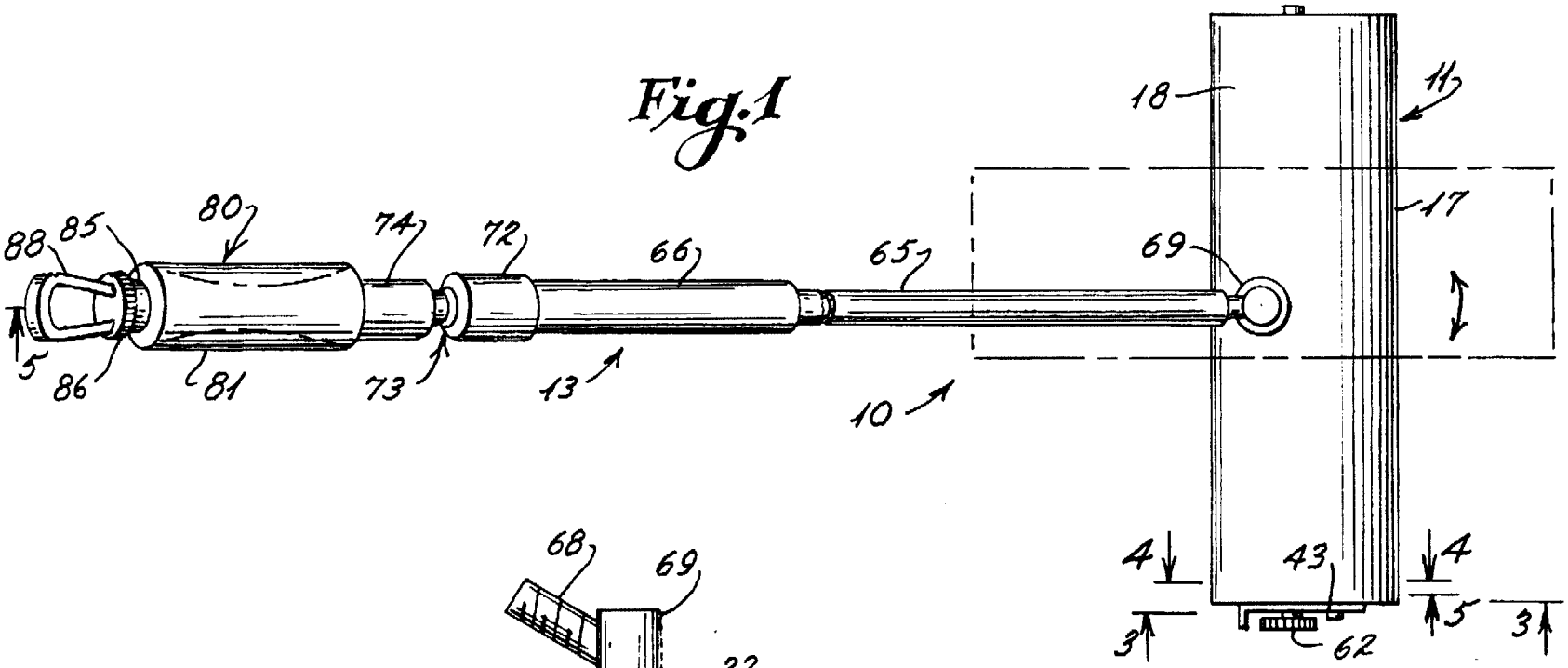
FIG. 1 is a top plan view of a preferred embodiment of the present invention showing the housing for a multi-purpose implement shown rotated to a dotted line position relative to a telescoping handle.
Figure 4:
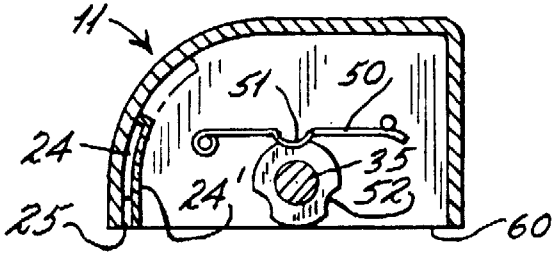
FIG. 4 is an enlarged cross-sectional view taken along line 4—4 of FIG. 1.

With continued reference to the drawings, the present invention will be described in greater detail. For purposes of the description and the claims, the term "cleaning element" refers not only to conventional cleaning elements such as sponges, mops, chamois, dusters, polishers, brushes, scrubbers and the like but also includes textured surface materials including sandpaper, emery material, surface grinding elements including screens and the like as well as other materials used to treat, clean or prepare various surfaces. In like manner, the use of the term "cleaning solution" or "cleaning liquid" within the specification and claims is directed to any liquids including water, soaps and other cleansing solutions, anti-bacterial solutions, detergents, tub and tile cleaners, waxes, polishes, pastes and the like.

The cleaning tool 10 includes an implement housing 11, a multi-purpose cleaning implement 12 and elongated handle 13. The housing is preferably formed of a plastic material and includes side walls 14 and 15, a rear wall 16, a curved forward wall 17 and an upper wall 18. A hollow nipple 19 extends from the upper wall 18 and includes a concave upper surface 20 in which a pivot ball 21 associated with a handle connector is selectively seated. The nipple is provided with screw threads on its outer surface for selectively mating with similar threads formed on a screw cap 22. The screw cap 22 includes an opening in its upper portion which selectively seats on the backside of the pivot ball 21, as specifically shown in FIG. 5. In this manner, the housing 11 may be pivoted to a plurality of positions relative to the handle. By adjusting the tension of the screw cap 22 relative to the nipple 19, the housing 11 may be securely retained in a fixed position as the nipple and the screw cap will compress on opposite sides of the pivot ball 21.

The open nipple 19 communicates with one or more passageways 24 which are formed inwardly of the housing 11 and extend along either or both of the front or rear inner surfaces. As shown, the passageway 24 extend along the front wall 17 to a plurality of spaced discharge openings 25. It is preferred that the openings are spaced along the full width of the housing between the side walls. The passageway 24 and openings thus define a liquid discharge header. In this manner, liquid being directed to the housing will be discharged relative to the cleaning implement at a point interiorly of the housing. This will ensure that liquid is supplied to the cleaning implement and not discharged outwardly of the housing during use. It is preferred that the passageway 24 be formed by molding a separate inner wall 24' relative to the outer wall although separate conduits may be provided which connect the nipple 19 to the discharge openings 25.

The multi-purpose cleaning implement 12 may take various configurations, however, it is preferred that at least three or more different cleaning elements be secured to the implement, as is shown in the drawing figures. Additional elements may be provided by changing the cross-sectional characteristics of the implement.

Figure 3:
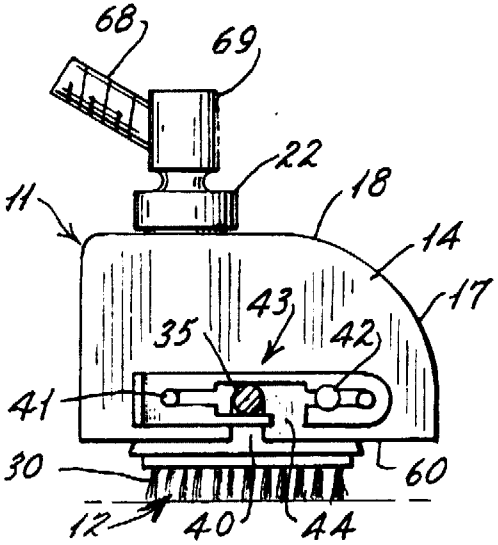
FIG. 3 is an enlarged cross-sectional view taken along line 3—3 of FIG. 1.

The implement includes a first brush cleaning element 30, a sponge cleaning element 31 and a cloth or dust cleaning element 32. Each of the cleaning elements is preferably adhesively secured to the side walls of the implement, however, the implement may be formed as a frame having the elements frictionally mounted or otherwise secured to the frame. The implement includes a central mounting shaft 35 having one end 36 for extending through an opening formed in side wall 15 of the housing and a second longer end 37 which extends through a slotted opening 40 provided in side wall 14 of the housing. A pair of spaced pins 41 and 42 are either integrally molded or provided in end wall 14 of the housing and, on the outside of the housing, support a locking clip 43 which is utilized to retain the end portion 37 of the central shaft 35 in mounted relationship within the housing 11. In this manner, by sliding the clip rearwardly from the position shown in FIG. 3, the clip is re-aligned so that an opening 44 therein aligns with the slotted opening 40, thereby allowing the implement shaft to be disengaged from the housing. It is preferred that the implement be removably mounted to the housing so that the entire implement may be taken from the housing and washed and replaced after cleaning. Further, cleaning implements having different cleaning elements may be selectively mounted within the housing by simply changing the implements as desired. It is noted that the locking clip 43 includes a pair of elongated slots at each end thereof for permitting a relative sliding movement of the locking clip relative to the retaining pins 41 and 42.

Figures 2, 7:
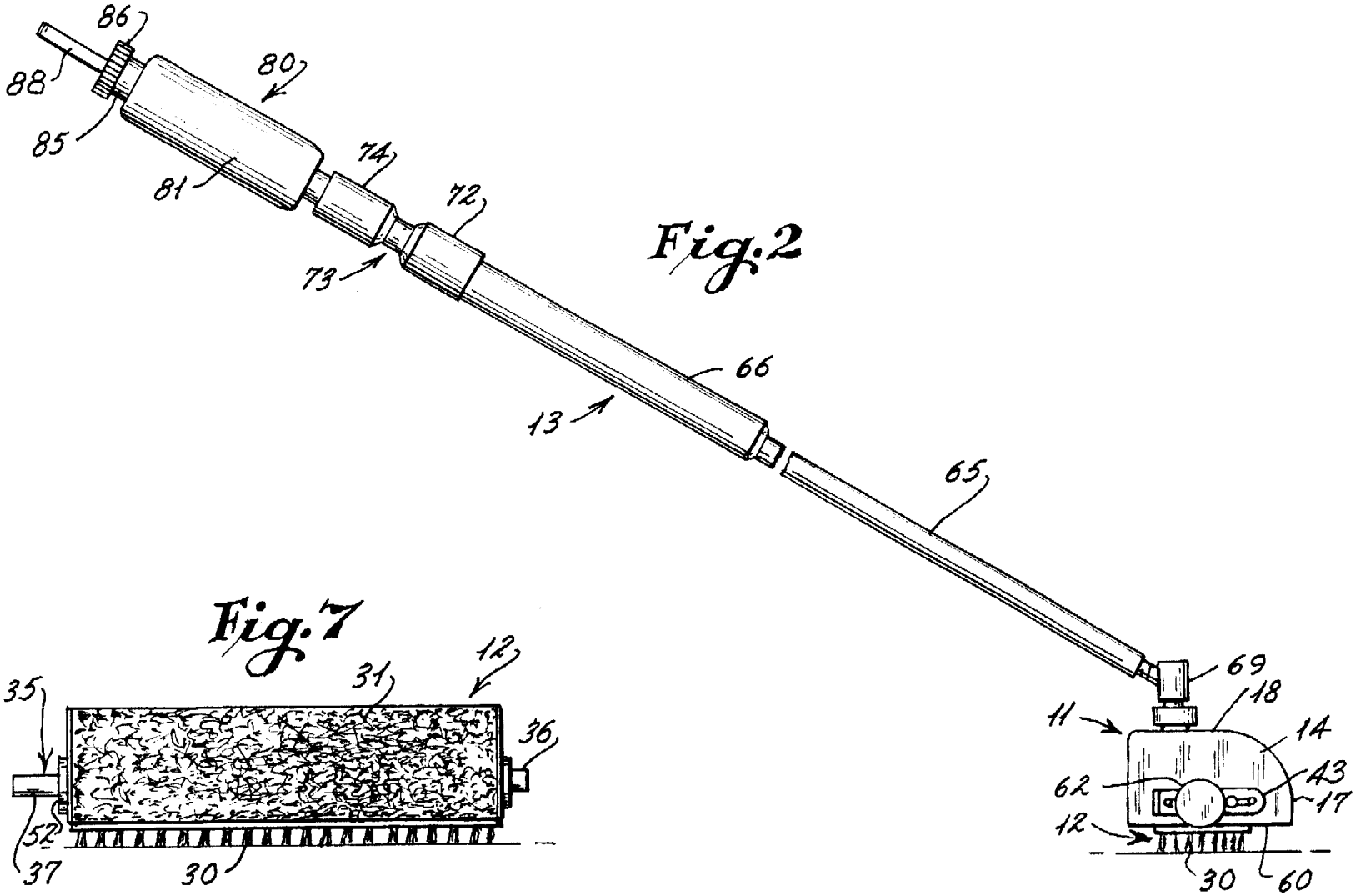
FIG. 2 is a right side view of the implement shown in FIG. 1.
FIG. 7 is a front elevational view of a preferred form of cleaning implement of the present invention taken along line 7—7 of FIG. 5.

Interiorly of the housing, the pins 41 and 42 also provide mounting for a retention spring 50. The spring is mounted about pin 42 and has an outer end flexibly engaged against pin 41. The locking spring includes a protrusion 51 which is engagable within one of a plurality of detents 52 provided in a washer or locking element which is securely fixed to shaft 35. The detents 52 are positioned so as to ensure that the implement is locked in a nonrotatable position within the housing when one of the cleaning elements 30, 31 or 32 is aligned with the opening 60 defining the bottom of the housing. As shown in FIG. 2, an adjustment knob 62 is securely mounted to end 37 of the shaft 35 by way of which the implement 12 may be selectively rotated.

The handle 13 is designed to be extendable from approximately a foot to several feet in length. The handle includes at least one hollow outer telescoping section 65 which is frictionally received within a hollow central section 66. Appropriate seating O-rings 67 are provided to prevent leakage of liquid through the hollow sections. The innermost portion of section 65 includes internal threads for selectively engaging the threads 68 of a hollow connector 69 associated with the ball joint element 21. In this manner, the handle 13 may be simply rotated from a locked engagement with the connector 69, thereby allowing the tool to be used without the handle. A liquid passageway 70 is provided through the connector 69 so as to communicate with the open nipple 19 of the housing 11.

Handle section 66 is frictionally mounted within a female socket 72 associated with a connector 73. Connector 73 includes a second female socket 74 having a valve element 75 mounted centrally thereof. The connector 73 is hollow so that the connector and the handle sections 65 and 66 form a passageway 78 which communicates with passageway 70 in the connector 69. The valve 75 is preferably a flexible flap valve having a central slit which is normally retained in a closed position but which may be opened toward the housing of the tool when pressure is applied to the rear face of the valve.

To supply liquid for use with the cleaning tool, a container 80 having flexible side walls 81 is selectively mounted to the female socket 74 of connector 73. The socket 74 is preferably of a size to function as a conventional conduit coupling. The container may be integrally formed with the connector 73, however, in a preferred embodiment, the container is a separate container having a closable throat portion 82 which is sealed by a cap (not shown) until placed into service or use with the cleaning tool. Upon removal of the cap, the throat 82 of the container is threaded within the socket 74. A gasket or O-rings (not shown) may be provided in the socket 74 for preventing leakage of liquid between the container 80 and the connector 73.

Figures 5, 6:
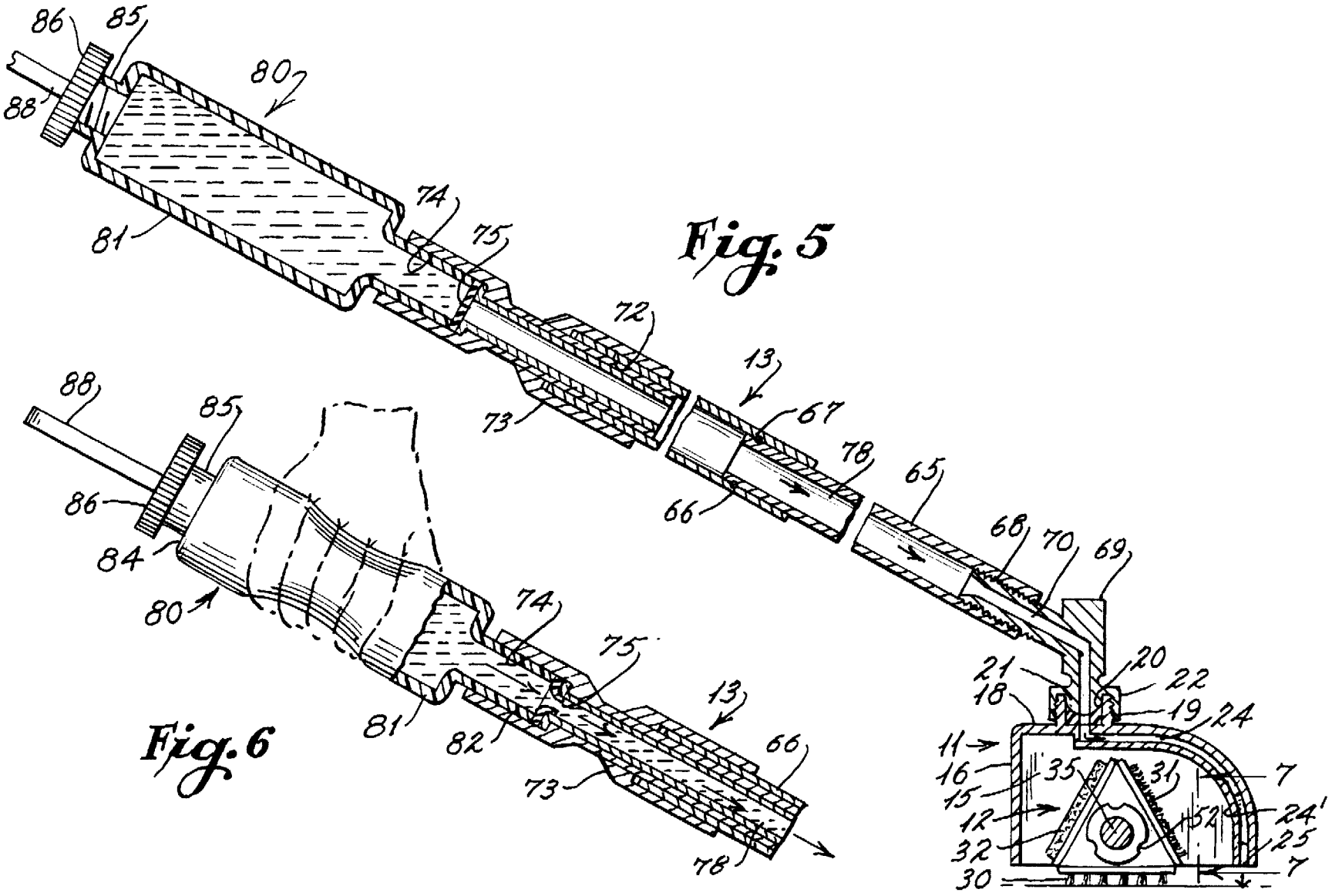
FIG. 5 is a cross-sectional view taken along line 5—5 of FIG. 1.
FIG. 6 is a partial cross-sectional illustrational view showing the manner in which the liquid container associated with the handle of the present invention is engaged so as to discharge fluid through a control valve associated with the handle.

With respect to FIG. 6, when pressure is applied to the side walls 81 of the container, the flap valve 75 is opened allowing liquids to be discharged through the passageway 78 to the discharge header in the housing.

In the preferred embodiment, the container may be also constructed so as to be readily refilled. In these instances, the container includes a rear wall 84 having a thread throat portion 85 to which a closing cap 86 is threadingly engaged. By removal of the cap 86, liquid may be resupplied to the interior of the container 80. To facilitate storage, a strap 88 may be integrally formed with the cap 86 so that the implement may be supported from an appropriate hook in a closet or other area.

Container 80 may also function as a mixing chamber by providing a conventional female coupling about the throat portion 85 so that a conventional hose may be directly connected to the container. Also, when the container is removed from the tool, a conventional hose may be connected within the socket 74 to thereby provide a continuous source of liquid to the tool.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. A multi-purpose cleaning tool for dispensing a cleaning liquid comprising:

a handle means having first and second ends, a housing pivotally adjustable relative to said handle means and having a lower opening therein, a cleaning implement mounted within said housing and having a plurality of differently oriented cleaning elements each of which are disposed within said housing;

mounting means for rotatably mounting said cleaning implement within said housing so as to selectively position one of said plurality of cleaning elements in an adjusted position so as to extend through said opening;

said handle means defining a liquid passageway therethrough, a hollow connector means for connecting said first end of said handle means in communication with said housing whereby liquid may be provided to said housing adjacent a selected one of said cleaning elements of said cleaning implement from said liquid passageway;

a liquid container mounted to said second end of said handle means; and valve means for controlling flow of liquid from said container to said liquid passageway.

2. The cleaning tool of claim 1 in which said container includes a bottom wall portion having an opening therein and cap means for selectively closing said opening in said bottom wall of said container whereby said container may be refilled with the cleaning liquid.

3. The cleaning tool of claim 2 in which said handle means includes at least one section which is telescopically slidably disposed relative to a second section whereby said handle may be selectively extended, and seal means for sealing said first and second sections in liquid tight relationship relative to one another.

4. The cleaning tool of claim 3 in which said handle means includes a socket in communication with said liquid passageway, said container including a first throat of a size to be cooperatively seated within said socket and said container being removably mounted to said handle means with said first throat portion within said socket and said container having flexible sidewalls to thereof permit cleaning liquid therein to be dispensed by compression of said sidewalls.

5. The cleaning tool of claim 1 in which said handle means includes a socket in communication with said liquid passageway, said container including a first throat of a size to be cooperatively seated within said socket and said container being removably mounted to said handle means with said first throat portion within said socket.

6. The cleaning tool of claim 5 in which said handle means includes at least one section which is telescopically slidably disposed within a second section whereby said handle may be selectively extended, and seal means for sealing said first and second sections in liquid tight relationship relative to one another.

7. The cleaning tool of claim 5 in which said container includes a bottom wall portion having an opening therein and cap means for selectively closing said opening in said bottom wall of said container whereby said container may be refilled with the cleaning liquid, and said container having flexible sidewalls to thereby permit cleaning liquid to be dispensed by compression of said sidewalls.

8. The cleaning tool of claim 1 in which said cleaning implement includes a central shaft and said mounting means including clip means for releasably securing said central shaft to spaced side walls of said housing.

9. The cleaning tool of claim 8 in which said housing includes resilient means for securing said cleaning implement in an adjusted position.

10. The cleaning tool of claim 1 including a liquid distribution header formed within said housing, said header including discharge openings adjacent said opening in said housing, and said header communicating with said liquid passageway through said connector means.

11. The cleaning tool of claim 10 in which said container includes a bottom wall portion having an opening therein and cap means for selectively closing said opening in said bottom wall of said container whereby said container may be refilled with the cleaning liquid.

12. The cleaning tool of claim 11 in which said handle means includes at least one section which is telescopically slidably disposed relative to a second section whereby said handle may be selectively extended, and seal means for sealing said first and second sections in liquid tight engagement relative to one another.

13. The cleaning tool of claim 12 in which said handle means includes a socket in communication with said liquid passageway, said container including a first throat of a size to be cooperatively seated within said socket and said container being removably mounted to said handle means with said first throat portion within said socket.

14. The cleaning tool of claim 10 in which said handle means includes a socket in communication with said liquid passageway, said container including a first throat of a size to be cooperatively seated within said socket and said container being removably mounted to said handle means with said first throat portion within said socket.

15. The cleaning tool of claim 10 in which said handle means includes at least one section which is telescopically slidably disposed relative to a second section whereby said handle may be selectively extended, and seal means for sealing said first and second sections in liquid tight relationship relative to one another.

16. The cleaning tool of claim 10 in which said handle means includes at least one section which is telescopically slidably disposed relative to a second section whereby said handle may be selectively extended, and seal means for sealing said first and second sections in fluid tight relationship relative to one another.

17. The cleaning tool of claim 10 in which said cleaning implement includes a central shaft and said mounting means includes clip means for releasably securing said shaft to spaced side walls of said housing.

18. The cleaning tool of claim 10 in which said connector means is adjustable to permit said housing to be pivotally adjusted relative to said handle means.

19. The cleaning tool of claim 18 in which said connector means includes a nipple extending from said housing, said nipple including a concave upper surface, said connector means further including a ball portion selectively receivable within said concave upper surface, and securing means for securing said ball portion relative to said concave upper surface whereby said housing may be selectively re-oriented and thereafter retained in position by manipulation of said securing means.

20. The cleaning tool of claim 1 in which said container includes flexible sidewalls to thereby permit dispensing of a cleaning liquid contained by squeezing said sidewalls.

* * * * *